US007701181B2

(12) United States Patent
Inoue

(10) Patent No.: US 7,701,181 B2
(45) Date of Patent: Apr. 20, 2010

(54) POWER SUPPLY DEVICE AND OPERATIONS CONTROL METHOD THEREOF

(75) Inventor: Yoshiyuki Inoue, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 311 days.

(21) Appl. No.: 11/894,854

(22) Filed: Aug. 21, 2007

(65) Prior Publication Data

US 2008/0054873 A1 Mar. 6, 2008

(30) Foreign Application Priority Data

Sep. 1, 2006 (JP) ..... 2006-237871

(51) Int. Cl.
*G05F 1/59* (2006.01)
*G05F 1/575* (2006.01)

(52) U.S. Cl. ..... 323/268; 323/274; 323/284

(58) Field of Classification Search ..... 323/225, 323/265, 266, 268, 274, 284, 285, 349, 350, 323/351, 269, 271
See application file for complete search history.

(56) References Cited

U.S. PATENT DOCUMENTS 6,229,289 B1 * 5/2001 Piovaccari et al. ..... 323/268
6,914,419 B2 * 7/2005 Katayama ..... 323/225
7,064,531 B1 * 6/2006 Zinn ..... 323/268
7,148,670 B2 * 12/2006 Inn et al. ..... 323/283
7,253,596 B2 * 8/2007 Yamamoto et al. ..... 323/281
7,397,151 B2 * 7/2008 Ishino ..... 307/150
2005/0088856 A1 4/2005 Yamamoto et al.

FOREIGN PATENT DOCUMENTS

CN 1617432 A 5/2005
JP 2005-130622 5/2005
JP 2006-34033 2/2006
WO WO 2006/070524 A1 7/2006

OTHER PUBLICATIONS

Nov. 14, 2008 official action in connection with a counterpart Chinese patent application No. 200710152656.5.
Jun. 19, 2009 Chinese official action (and English translation thereof) in connection with a counterpart Chinese patent application No. 200710152656.5.

* cited by examiner

*Primary Examiner*—Gary L Laxton
(74) *Attorney, Agent, or Firm*—Cooper & Dunham LLP

(57) ABSTRACT

A LDO and a switching regulator are connected in parallel with each other. The power supply device selects and actuates either of the LDO or the switching regulator in accordance with a switching signal from the outside. When making the switch from the LDO to the switching regulator so as to be actuated, the power supply device causes operation periods of the LDO and the switching regulator to overlap each other. At least during the period in which the operation periods overlap each other, the power supply device makes current drive performance of a synchronous rectification transistor of the switching regulator lower and makes the same return to a normal state after the LDO stops its operation.

11 Claims, 4 Drawing Sheets

POWER SUPPLY DEVICE AND OPERATIONS CONTROL METHOD THEREOF

BACKGROUND OF THE INVENTION

1. Field of the Invention

This disclosure relates to a power supply device that switches and outputs either of the output voltage of a LDO (Low Dropout) converter (hereinafter referred to as LDO) serving as a linear regulator or that of a switching regulator, depending on a load current so as to lower current consumption at light load, thereby making it possible to reduce overall power consumption, and to an operations control method thereof.

2. Description of the Related Art

As a known method for outputting an input voltage after converting it into a predetermined voltage in a power supply device, there has widely been employed one that converts power with high conversion efficiency by the use of a switching regulator. In this case, high power conversion efficiency can be obtained at heavy load, but current consumption of the switching regulator itself is increased at light load, resulting in lowering overall conversion efficiency. Therefore, a LDO with low current consumption is used at light load to achieve low current consumption, while a switching regulator is used at heavy load to achieve high efficiency. Furthermore, since an overshoot or an undershoot occurs in an output voltage when an LDO and a switching regulator are switched with each other, there is a necessity to reduce the overshoot and the undershoot in the output voltage occurring at the switching in consideration of the method and the timing of switching between the LDO and the switching regulator.

Accordingly, there has been disclosed a method which sets a simultaneous operating period at the switching from an LDO for constantly controlling an output voltage to a switching regulator, which switches the drive performance of P-ch transistors and N-ch transistors constituting the driver unit of the switching regulator to a low performance mode during the simultaneous operating period, and which switches to a normal mode after stopping the operation of the LDO (see, e.g., Patent Document 1).

Patent Document 1: JP-A-2005-130622

With this method of switching from the LDO to the switching regulator, however, the drive performance of the P-ch transistors constituting the driver unit of the switching regulator is reduced during the period in which operation sections of the LDO and the switching regulator overlap each other in consideration of the timing of switching from the LDO to the switching regulator. Therefore, the loss portion caused by on-resistance of the P-ch transistors is not negligible when a load current flows. As a result, the drop of an output voltage or the like occurs, thereby making it difficult to supply a steady voltage.

SUMMARY

In an aspect of this disclosure, there is provided a power supply device equipped with an LDO and a switching regulator in parallel and used by switching between the LDO and the switching regulator depending on a current load situation, thereby making it possible to achieve overall high efficiency and supply a steady output voltage even at the switching; and an operations control method thereof.

According to another aspect, there is provided a power supply device that outputs an input voltage input to an input terminal from a predetermined output terminal as an output voltage after converting it into a predetermined voltage. The device comprises a synchronous rectification switching regulator that outputs the input voltage to the output terminal after converting it into a predetermined voltage; a linear regulator that outputs the input voltage to the output terminal after converting it into a predetermined voltage; and a timing adjustment circuit unit that controls driving of the linear regulator and the synchronous rectification switching regulator in accordance with a control signal input from outside. The synchronous rectification switching regulator is controlled to be driven by the control signal from the outside and reduces current drive performance of a synchronous rectification transistor that discharges an inductor charged with the input voltage by a switching operation of a switching transistor until a predetermined signal has been input from the timing adjustment circuit unit after being started with the control signal from the outside.

Further, when the control signal from the outside indicating the switch from the linear regulator to the synchronous rectification switching regulator is input, the timing adjustment circuit unit actuates the linear regulator during a first predetermined time and stops the operation of the linear regulator when the first predetermined time has elapsed.

Further, the timing adjustment circuit unit outputs the predetermined signal to the synchronous rectification switching regulator to reduce the current drive performance of the synchronous rectification transistor until a second predetermined time longer than the first predetermined time has elapsed after the synchronous rectification switching regulator is started.

Specifically, the synchronous rectification switching regulator comprises a switching transistor that performs switching operations in accordance with a first input control signal; the inductor charged with the input voltage by the switching operation of the switching transistor; a first synchronous rectification transistor that performs switching operations in accordance with a second input control signal to discharge the inductor; a second synchronous rectification transistor having current drive performance lower than that of the first synchronous rectification transistor and performing switching operations in accordance with a third input control signal to discharge the inductor; a control circuit unit that performs switching control with respect to the switching transistor so that the output voltage output from the output terminal becomes the predetermined voltage while causing the first and/or second synchronous rectification transistor(s) to perform switching operations contrary to the switching transistor. The control circuit unit turns off the first synchronous rectification transistor to cut off an electrical connection while using the second synchronous rectification transistor to discharge the inductor during the signal for reducing the current drive performance of the synchronous rectification transistor being input from the timing adjustment circuit unit.

In this case, the control circuit unit comprises an error amplification circuit that amplifies and outputs a voltage difference between a proportional voltage proportional to the output voltage as a voltage of the output terminal and a predetermined reference voltage, and the first predetermined time is equal to or longer than time required for making an output voltage of the error amplification circuit become equal to or greater than a predetermined value after the error amplification circuit is started, at the starting of the synchronous rectification switching regulator.

According to another aspect, there is provided a power supply device that outputs an input voltage input to an input terminal from a predetermined output terminal as an output voltage after converting it into a predetermined voltage. The device comprises a synchronous rectification switching regulator that outputs the input voltage to the output terminal after converting it into a predetermined voltage; a linear regulator that outputs the input voltage to the output terminal after converting it into a predetermined voltage; and a timing adjustment circuit unit that controls driving of the linear regulator and the synchronous rectification switching regulator in accordance with a control signal input from outside. The synchronous rectification switching regulator comprises an error amplification circuit that amplifies and outputs a voltage difference between a proportional voltage proportional to the output voltage as a voltage of the output terminal and a predetermined reference voltage, and forcibly turns off each of a switching transistor that charges an inductor and a synchronous rectification transistor that discharges the inductor to cut off an electrical connection until an output voltage of the error amplification circuit has become equal to or greater than a predetermined value after the error amplification circuit is started, at the starting of the synchronous rectification switching regulator.

Further, when the control signal from the outside indicating the switch and drive from the linear regulator to the synchronous rectification switching regulator is input, the timing adjustment circuit unit actuates each of the linear regulator and the synchronous rectification switching regulator during a first predetermined time and stops operation of the linear regulator when the first predetermined time has elapsed.

Specifically, the first predetermined time is equal to or longer than time required for making the output voltage of the error amplification-circuit become equal to or greater than the predetermined value after the error amplification circuit is started, at the starting of the synchronous rectification switching regulator.

According to still another aspect, there is provided an operations control method of a power supply device that comprises a synchronous rectification switching regulator and a linear regulator that outputs an input voltage input to an input terminal from a predetermined output terminal as an output voltage after converting it into a predetermined voltage and switches and actuates either of the synchronous rectification switching regulator or the linear regulator in accordance with a control signal from outside. The method comprises actuating the linear regulator during a first predetermined time and reducing current drive performance of a synchronous rectification transistor in the synchronous rectification switching regulator until a second predetermined time longer than the first predetermined time has elapsed when the control signal from the outside indicating the switch from the linear regulator to the synchronous rectification switching regulator is input.

Further, the operation of the linear regulator is stopped when the first predetermined time has elapsed after the control signal from the outside indicating the switch from the linear regulator to the synchronous rectification switching regulator is input.

According to still another aspect, there is provided an operations control method of a power supply device that comprises a synchronous rectification switching regulator and a linear regulator that outputs an input voltage input to an input terminal from a predetermined output terminal as an output voltage after converting it into a predetermined voltage and switches and actuates either of the synchronous rectification switching regulator or the linear regulator in accordance with a control signal from outside. The method comprises forcibly stopping an output of a voltage of the synchronous rectification switching regulator until a signal voltage obtained by amplifying a voltage difference between a proportional voltage proportional to the output voltage as a voltage of the output terminal and a predetermined reference voltage becomes equal to or greater than a predetermined value when the control signal from the outside indicating the switch from the linear regulator to the synchronous rectification switching regulator is input.

Further, the linear regulator is actuated until the signal voltage obtained by amplifying the voltage difference between the proportional voltage and the predetermined reference voltage becomes equal to or greater than the predetermined value when the control signal from the outside indicating the switch from the linear regulator to the synchronous rectification switching regulator is input.

According to preferred embodiments of the above-mentioned power supply device and operations control method, the linear regulator is actuated during the first predetermined time, and the current drive performance of the synchronous rectification transistor in the synchronous rectification switching regulator is reduced until the second predetermined time longer than the first predetermined time has elapsed when the control signal from the outside indicating the switch from the linear regulator to the synchronous rectification switching regulator is input. Accordingly, it is possible to achieve low current consumption by the use of the linear regulator with low current consumption at light load and achieve high efficiency by the use of the switching regulator at heavy load. In addition, it is possible to reduce the undershoot in the output voltage which could occur right after the switching regulator is started and supply a steady output voltage.

Further, according to preferred embodiments of the above-mentioned power supply device and operations control method, the output of a voltage of the synchronous rectification switching regulator is forcibly stopped until a signal voltage obtained by amplifying a voltage difference between the proportional voltage proportional to the output voltage as a voltage of the output terminal and the predetermined reference voltage becomes equal to or greater than the predetermined value when the control signal from the outside indicating the switch from the linear regulator to the synchronous rectification switching regulator is input.

DETAILED DESCRIPTION OF THE PREFERRED EMBODIMENTS

Next, a description is specifically made of the present invention based on the embodiments as shown in the accompanying drawings.

First Embodiment

Figure 1:
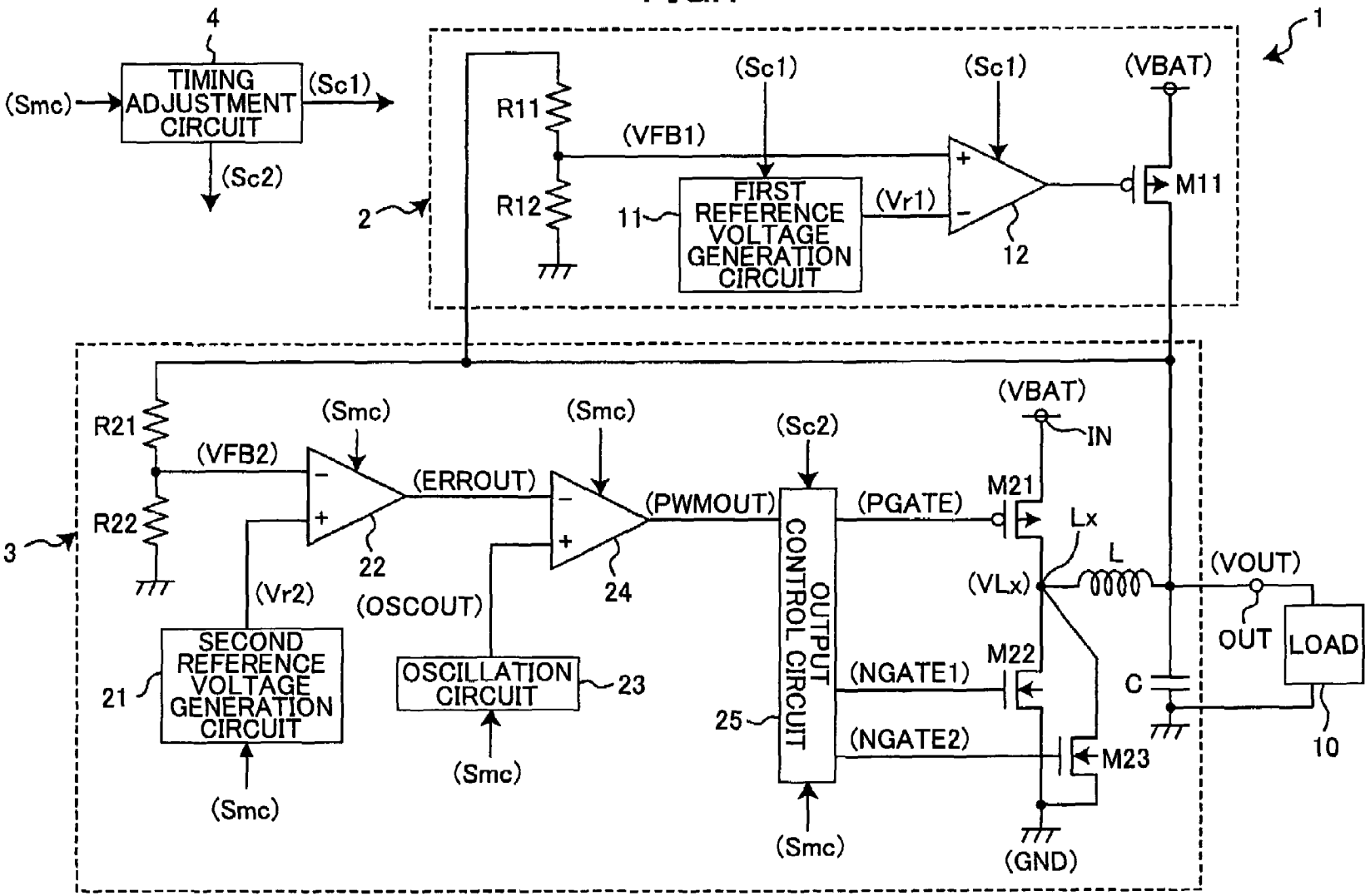
FIG. 1 is a diagram showing a circuit example of a power supply device of a first embodiment of the present invention.

FIG. 1 is a diagram showing a circuit example of a power supply device of a first embodiment of the present invention.

In FIG. 1, the power supply device 1 converts an input voltage VBAT input to an input terminal IN into a predetermined constant voltage V1 and outputs the converted voltage to a load 10 from an output terminal OUT as an output voltage VOUT.

The power supply device 1 is composed of a LDO 2 serving as a linear regulator, a switching regulator 3 serving as a DC-DC converter, and a timing adjustment circuit 4 that controls driving of the LDO 2 and switching regulator 3 in accordance with a switching signal Smc input from the outside. The switching signal Smc is input so as to actuate the LDO 2 in a low current consumption operation mode such as a sleep mode and actuate the switching regulator 3 in a normal operation mode. The output terminals of the LDO 2 and the switching regulator 3 and their input terminals are connected to the output terminal OUT of the power supply device 1 and its input terminal IN, respectively. Note that the timing adjustment circuit 4 constitutes a timing adjustment circuit unit, and the switching regulator 3 and the timing adjustment circuit 4 excluding the LDO 2, an inductor L, and a capacitor C (in some cases, at least one of a switching transistor M21 and synchronous rectification transistors M22 and M23 is excluded) may be integrated onto one IC.

The LDO 2 reduces the input voltage VBAT to be converted into the predetermined constant voltage V1 and outputs the converted voltage from the output terminal OUT as the output voltage VOUT. Furthermore, the LDO 2 operates when a predetermined control signal Sc1, for example, a low-level control signal Sc1 is input from the timing adjustment circuit 4 and stops its operation when a high-level control signal Sc1 is input from the timing adjustment circuit 4 so as to reduce current consumption.

The switching regulator 3 reduces the input voltage VBAT to be converted into the predetermined constant voltage V1 and outputs the converted voltage from the output terminal OUT as the output voltage VOUT. Furthermore, the switching regulator 3 operates when a predetermined switching signal Smc, for example, a high-level switching signal Smc is input and stops its operation when a low-level switching signal Smc is input so as to reduce current consumption.

The LDO 2 includes a first reference voltage generation circuit 11 that generates and outputs a predetermined reference voltage Vr1, an error amplification circuit 12, an output transistor M11 composed of a PMOS transistor, and resistances R11 and R12 for detecting the output voltage VOUT.

The output transistor M11 is connected between the input voltage VBAT and the output terminal OUT, and the gate of the output transistor M11 is connected to the output end of the error amplification circuit 12. The resistances R11 and R12 are connected in series between the output terminal OUT and ground potential GND, and a divided voltage VFB1 resulting from the division of the output voltage VOUT is output from a junction between the resistances R11 and R12. The reference voltage Vr1 is input to the inverting input terminal of the error amplification circuit 12 and the divided voltage VFB1 is input to its non-inverting input terminal. Furthermore, the control signal Sc1 from the timing adjustment circuit 4 is input to the first reference voltage generation circuit 11 and the error amplification circuit 12.

On the other hand, the switching regulator 3 includes a switching transistor M21 composed of a PMOS transistor, which performs switching operations for controlling the output of the input voltage VBAT and synchronous rectification transistors M22 and M23 composed of NMOS transistors. The synchronous rectification transistor M23 has current drive performance lower than that of the synchronous rectification transistor M22. In addition, the switching regulator 3 includes a second reference voltage generation circuit 21 that generates and outputs a predetermined reference voltage Vr2, resistances R21 and R22 for detecting the output voltage VOUT, the inductor L, the capacitor C for smoothing, an error amplification circuit 22, an oscillation circuit 23, a PWM comparator 24, and an output control circuit 25. Note that the synchronous rectification transistors M22 and M23 constitute first and second synchronous rectification transistors, respectively, and the second reference voltage generation circuit 21, the resistances R21 and R22 for detecting the output voltage VOUT, the error amplification circuit 22, the oscillation circuit 23, the PWM comparator 24, and the output control circuit 25 constitute a control circuit unit.

The resistances R21 and R22 for detecting the output voltage VOUT divide the output voltage VOUT to generate and output a divided voltage VFB2. Furthermore, the error amplification circuit 22 amplifies a voltage difference between the input divided voltage VFB2 and the reference voltage Vr2 to generate and output an output signal ERROUT. Furthermore, the oscillation circuit 23 generates and outputs a triangle-wave signal with a predetermined frequency (for example, 2 Mhz), and the PWM comparator 24 compares the voltage of the output signal ERROUT from the error amplification circuit 22 with that of the triangle-wave signal OSCOUT and generates an on-duty cycle pulse signal PWMOUT for performing PWM control depending on the comparison result and outputs the generated signal to the output control circuit 25. The output control circuit 25 generates and outputs control signals PGATE, NGATE 1, and NGATE 2 in accordance with the input pulse signal PWMOUT.

The switching transistor M21 and the synchronous rectification transistor M22 are connected in series between the input terminal IN and the ground potential GND, and the synchronous rectification transistor M23 is connected in parallel with the synchronous rectification transistor M22. A junction between the switching transistor M21 and the synchronous rectification transistors M22 and M23 is Lx. The inductor L is connected between the junction Lx and the output terminal OUT, the resistances R21 and R22 are connected in series between the output terminal OUT and the ground potential GND, the capacitor C is connected between the output terminal OUT and the ground potential GND, and the divided voltage VFB2 is output from a junction between the resistances R21 and R22. Furthermore, the divided voltage VFB2 and the reference voltage Vr2 are input to the inverting input end – and the non-inverting input end +, respectively, of the error amplification circuit 22, and the output end of the error amplification circuit 22 is connected to the inverting input end – of the PWM comparator 24.

Furthermore, the triangle-wave signal OSCOUT is input to the non-inverting input end + of the PWM comparator 24, and the pulse signal PWMOUT output from the PWM comparator 24 is input to the output control circuit 25. The output control circuit 25 generates and outputs the control signals PGATE, NGATE 1, and NGATE 2 in accordance with the input pulse signal PWMOUT. The control signals PGATE, NGATE 1, and NGATE 2 are input to the gate of the switching transistor M21, that of the synchronous rectification transistor M22, and that of the synchronous rectification transistor M23, respectively. Furthermore, the switching signal Smc is input to the second reference voltage generation circuit 21, the error amplification circuit 22, the oscillation circuit 23, the PWM comparator 24, and the output control circuit 25, and the control signal Sc2 from the timing adjustment circuit 4 is further input to the output control circuit 25. The voltage at the junction Lx is smoothed by the inductor L and the capacitor C and output from the output terminal OUT as the output voltage VOUT.

Figure 2:
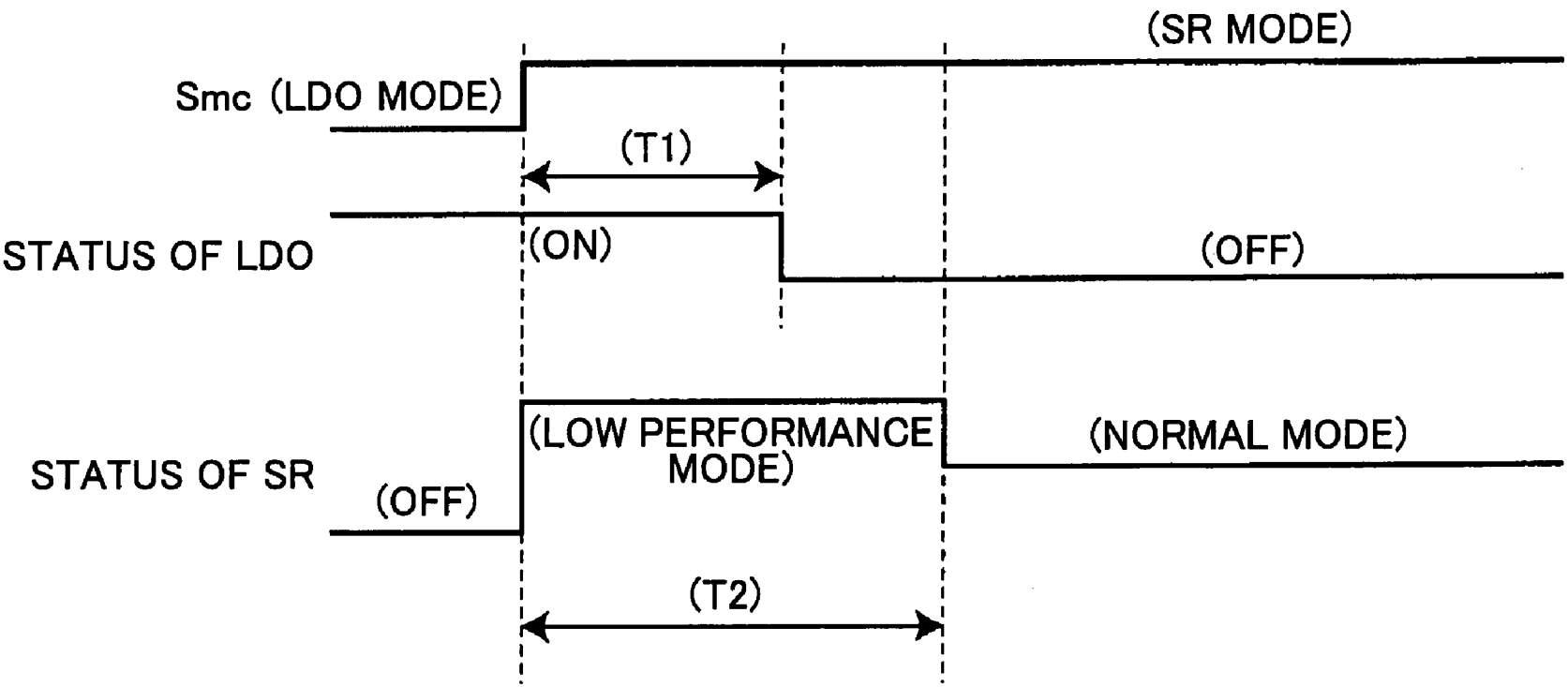
FIG. 2 is a timing chart showing an operations example of the power supply device of FIG. 1.

With this configuration, FIG. 2 is a timing chart showing an operations example of the power supply device 1 of FIG. 1. Referring to FIG. 2, a description is now made of the operations of the power supply device 1 of FIG. 1.

During the period in which the low-level switching signal Smc is input, the timing adjustment circuit 4 outputs the high-level control signal Sc1, while the second reference voltage generation circuit 21, the error amplification circuit 22, the oscillation circuit 23, the PWM comparator 24, and the output control circuit 25 individually stop their operation to reduce current consumption. At this time, the switching transistor M21 and the synchronous rectification transistors M22 and M23 are turned off to cut off an electrical connection, the control signal Sc2 output from the timing adjustment circuit 4 may be of a high-level or a low-level, and the timing adjustment circuit 4 may stop the output of the control signal Sc2.

The first reference voltage generation circuit 11 and the error amplification circuit 12 of the LDO 2 individually operate, and the error amplification circuit 12 controls the operation of the output transistor M11 so that the divided voltage VFB1 becomes the reference voltage Vr1 and controls the output current output from the output transistor M11 to the load 10. Since the input of the low-level switching signal Smc causes the LDO 2 to operate and causes the switching regulator 3 to stop its operation in this manner, the output voltage of the LDO 2 is output from the output terminal OUT of the power supply device 1.

Next, when the switching signal Smc is raised to a high level, the second reference voltage generation circuit 21, the error amplification circuit 22, the oscillation circuit 23, the PWM comparator 24, and the output control circuit 25 individually operate to start the switching regulator 3, while the timing adjustment circuit 4 outputs the high-level control signal Sc2. As a result, the LDO 2 and the switching regulator 3 are together in an operating state, and the output control circuit 25 of the switching regulator 3 uses the synchronous rectification transistor M23 having low current drive performance while causing the synchronous rectification transistor M22 having high current drive performance to be turned off to cut off an electrical connection, thereby establishing a low performance mode for performing low current drive.

In the switching regulator 3, the voltage of the output signal ERROUT from the error amplification circuit 22 is reduced as the output voltage VOUT increases, and the duty cycle of the pulse signal PWMOUT from the PWM comparator 24 is decreased. As a result, the ON time of the switching transistor M21 becomes short, and accordingly, the ON time of the synchronous rectification transistor, for example, the synchronous rectification transistor M23 in the low-current drive performance mode becomes long, so that output voltage VOUT is controlled to be reduced.

Furthermore, the voltage of the output signal ERROUT from the error amplification circuit 22 is boosted as the output voltage VOUT decreases, and the duty cycle of the pulse signal PWMOUT from the PWM comparator 24 is increased. As a result, the ON time of the switching transistor M21 becomes long, and accordingly, the ON time of the synchronous rectification transistor, for example, the synchronous rectification transistor M23 in the low-current drive performance mode becomes short, so that the output voltage VOUT is controlled to be boosted. Through the repetition of such operations, the output voltage VOUT is controlled to be constant at a predetermined voltage.

On the other hand, when the switching signal Smc is raised to a high level to start the switching regulator 3, the output signal ERROUT from the error amplification circuit 22 does not reach a desired voltage, thereby causing an error in the on-duty cycle of the switching transistor M21 from a required value. Since the on-duty cycle is particularly small right after the switching regulator 3 is started, an undershoot is caused to occur in the output voltage VOUT. Accordingly, even if the on-duty cycle of the switching transistor M21 is small, the reduction of the drive performance of the synchronous rectification transistor at the starting of the switching regulator 3 makes the current drawing performance of the synchronous rectification transistor into the ground potential GND lower, thereby making it possible to reduce the undershoot in the output voltage VOUT.

Next, when a first predetermined time T1 has elapsed after the switching signal Smc is raised to a high level, the timing adjustment circuit 4 causes the control signal Sc1 to fall to a low level, stops the operations of the first reference voltage generation circuit 11 and the error amplification circuit 12 to reduce current consumption, and turns off the output transistor M11 to stop the operation of the LDO 2. Note that only the operation of the error amplification circuit 12 may be stopped when the operation of the LDO 2 is stopped. Moreover, when a second predetermined time T2 longer than the first predetermined time T1 has elapsed after the switching signal Smc is raised to a high level, the timing adjustment circuit 4 causes the control signal Sc2 to fall to a low level, and the output control circuit 25 of the switching regulator 3 uses the synchronous rectification transistor M22 having high current drive performance while causing the synchronous rectification transistor M23 having low current drive performance to be turned off to cut off an electrical connection, thereby shifting from a low performance mode to a normal mode. The first predetermined time T1 is set equal to or longer than that required for making the voltage of the output signal ERROUT of the error amplification circuit 22 become equal to or greater than a predetermined value at the starting of the switching regulator 3.

Note that, in the above description, the synchronous rectification transistors M22 and M23 are used by switching in such a manner that they are used in a normal mode and a low performance mode, respectively. Alternatively, the synchronous rectification transistors M22 and M23 may be used in a normal mode and only the synchronous rectification transistor M23 may be used in a low performance mode.

Thus, in the power supply device 1 of the first embodiment of the present invention, the LDO 2 that outputs the input voltage VBAT to the common output terminal OUT after converting it into the predetermined output voltage VOUT and the switching regulator 3 that switches the input voltage VBAT to be converted into the predetermined output voltage VOUT and outputs the converted voltage to the common output terminal OUT are connected in parallel with each other. The power supply device 1 selects and actuates either of the LDO 2 or the switching regulator 3 in accordance with the switching signal Smc from the outside. When making the switch from the LDO 2 to the switching regulator 3 so as to be actuated, the power supply device 1 causes the operation periods of the LDO 2 and the switching regulator 3 to overlap each other. At least during the period in which the operation periods overlap each other, the power supply device 1 makes the current drive performance of the synchronous rectification transistor of the switching regulator 3 lower and makes the same returned to a normal state after the LDO 2 stops its operation. Accordingly, it is possible to achieve low current consumption by the use of the LDO 2 with low current consumption at light load and achieve high efficiency by the use of the switching regulator 3 at heavy load. In addition, it is possible to reduce the undershoot in the output voltage VOUT which could occur right after the switching regulator 3 is started and supply a steady output voltage.

Second Embodiment

In the above first embodiment, the synchronous rectification transistor having the low current drive performance is used until the second predetermined time T2 has elapsed after the switching regulator 3 is started. Alternatively, both of the switching transistor and the synchronous rectification transistor may be turned off to cut off an electrical connection until the output voltage of the error amplification circuit 22 becomes equal to or greater than a predetermined value at the starting of the switching regulator 3. A description is now made of this modification as a second embodiment.

Figure 3:
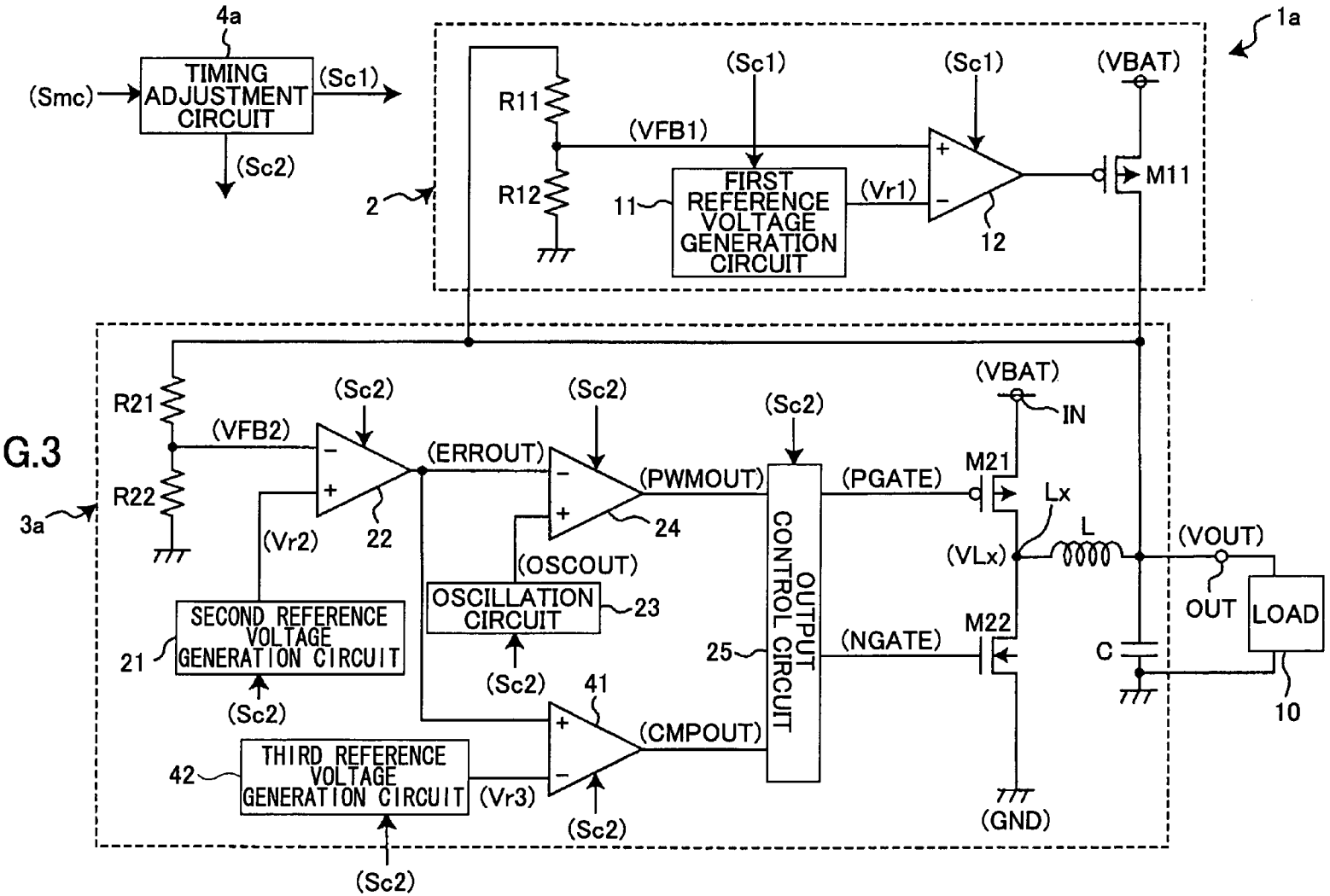
FIG. 3 is a diagram showing a circuit example of a power supply device according to a second embodiment of the present invention.

FIG. 3 is a diagram showing a circuit example of the power supply device according to the second embodiment of the present invention. In FIG. 3, components the same as or similar to those of FIG. 1 are indicated by the same numerals and are not be described below. Here, only parts different from FIG. 1 are described.

FIG. 3 is different from FIG. 1 in that the synchronous rectification transistor M23 of FIG. 1 is eliminated, a comparator 41 and a third reference voltage generation circuit 42 that generates a predetermined reference voltage Vr3 are added so that the operations of the output control circuit 25 of FIG. 1 are changed and the respective components of the switching regulator 3 of FIG. 1 operate or stop their operation in accordance with the control signal Sc2 from the timing adjustment circuit 4. Accordingly, the output control circuit 25, the switching regulator 3, the timing adjustment circuit 4, and the power supply device 1 of FIG. 1 are represented here as an output control circuit 25*a*, a switching regulator 3*a*, a timing adjustment circuit 4*a*, and a power supply device 1*a*, respectively.

In FIG. 3, the power supply device 1*a* converts the input voltage VBAT input to the input terminal IN into the predetermined constant voltage V1 and outputs the converted voltage to the load 2 from the output terminal OUT as the output voltage VOUT.

The power supply device 1*a* is composed of the LDO 2, the switching regulator 3*a* serving as a DC-DC converter, and the timing adjustment circuit 4*a* that controls driving of the LDO 2 and switching regulator 3*a* in accordance with a switching signal Smc input from the outside. The switching signal Smc is input so as to actuate the LDO 2 in a low current consumption operation mode such as a sleep mode and actuate the switching regulator 3*a* in a normal operation mode. The output terminals of the LDO 2 and the switching regulator 3*a* and the input terminals thereof are connected to the output terminal OUT of the power supply device 1*a* and the input terminal IN thereof, respectively. Note that the timing adjustment circuit 4*a* constitutes a timing adjustment circuit unit, and the switching regulator 3*a* and the timing adjustment circuit 4*a* excluding the LDO 2, the inductor L, and the capacitor C (in some cases, at least one of the switching transistor M21 and synchronous rectification transistors M22 and M23 is excluded) may be integrated onto one IC.

The switching regulator 3*a* reduces the input voltage VBAT to be converted into the predetermined constant voltage V1 and outputs the converted voltage from the output terminal OUT as the output voltage VOUT. Furthermore, the switching regulator 3*a* operates when a predetermined control signal Sc2, for example, a high-level control signal Sc2 is input from the timing adjustment circuit 4*a* and stops its operation when a low-level control signal Sc2 is input from the timing adjustment circuit 4*a* so as to reduce current consumption.

The switching regulator 3*a* includes the switching transistor M21, the synchronous rectification transistor M22, the second reference voltage generation circuit 21, the resistances R21 and R22 for detecting the output voltage VOUT, the inductor L, the capacitor C for smoothing, the error amplification circuit 22, the oscillation circuit 23, the PWM comparator 24, the output control circuit 25*a*, the comparator 41, and the third reference voltage generation circuit 42 that generates and outputs the predetermined reference voltage Vr3. Note that the second reference voltage generation circuit 21, the resistances R21 and R22 for detecting the output voltage VOUT, the error amplification circuit 22, the oscillation circuit 23, the PWM comparator 24, the output control circuit 25*a*, the comparator 41, and the third reference voltage generation circuit 42 constitute a control circuit unit.

The output control circuit 25*a* generates and outputs control signals PGATE and NGATE in accordance with an input pulse signal PWMOUT. The control signals PGATE and NGATE are input to the gates of the switching transistors M21 and M22, respectively. Furthermore, the reference voltage Vr3 and an output signal ERROUT are input to the inverting input end − and the non-inverting input end +, respectively, of the comparator 41, and the output signal CMPOUT from the comparator 41 is input to the output control circuit 25*a*. Furthermore, the control signal Sc2 from the timing adjustment circuit 4*a* is input to the second reference voltage generation circuit 21, the error amplification circuit 22, the oscillation circuit 23, the PWM comparator 24, the output control circuit 25*a*, the comparator 41, and the third reference voltage generation circuit 42.

Figure 4:
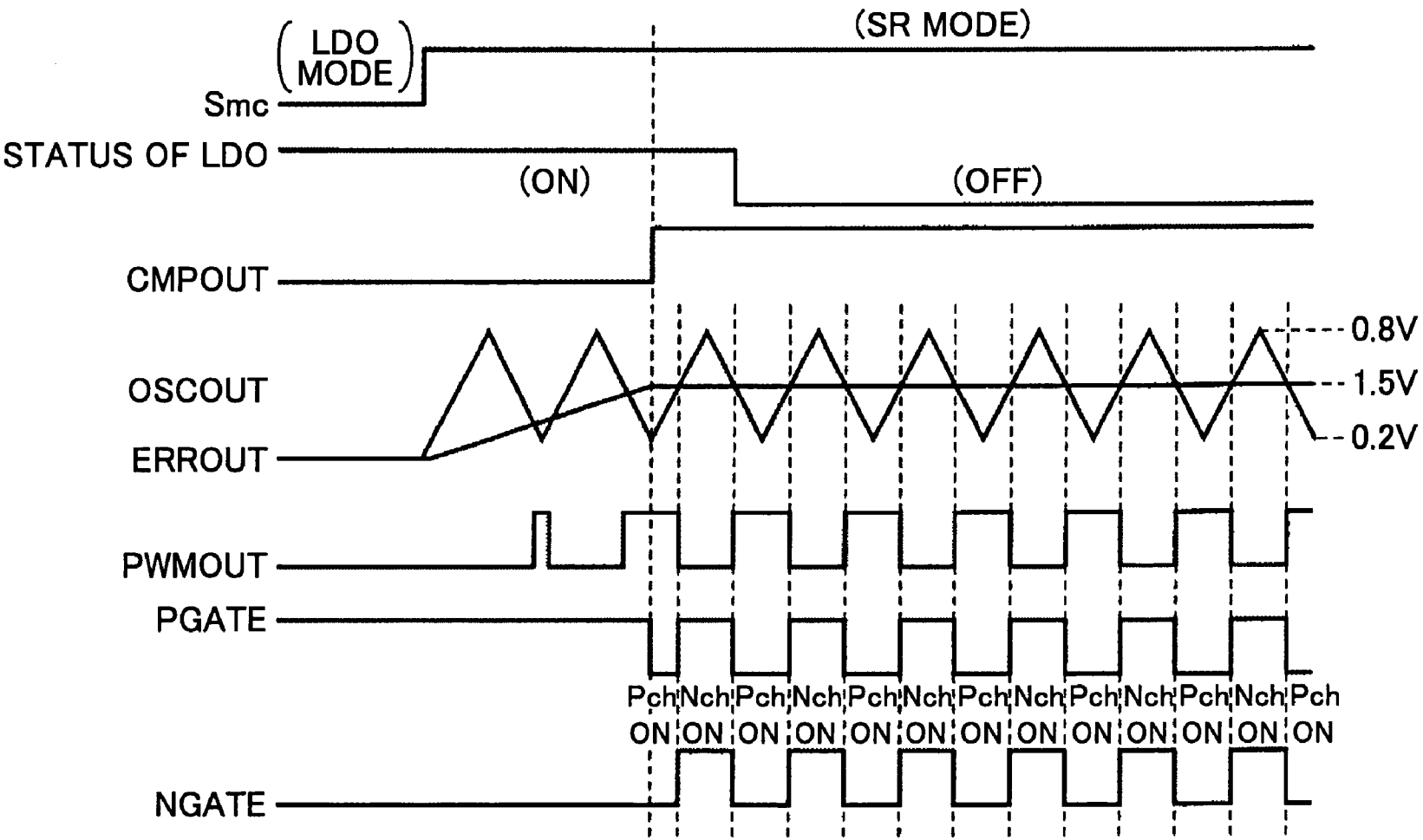
FIG. 4 is a timing chart showing examples of respective signals of FIG. 3.

With this configuration, FIG. 4 is a timing chart showing examples of the respective signals of FIG. 3. Referring to FIG. 4, a description is now made of the operations of the power supply device 1*a* of FIG. 3.

During the period in which the low-level switching signal Smc is input, the timing adjustment circuit 4*a* outputs the high-level control signal Sc1 as well as the low-level control signal Sc2. Thus, the first reference voltage generation circuit 11 and the error amplification circuit 12 of the LDO 2 individually operate, and the error amplification circuit 12 controls the operation of the output transistor M11 so that the divided voltage VFB1 becomes the reference voltage Vr1 and controls the output current output from the output transistor M11 to the load 10.

As opposed to this, in the switching regulator 3, the second reference voltage generation circuit 21, the error amplification circuit 22, the oscillation circuit 23, the PWM comparator 24, the output control circuit 25*a*, the comparator 41, and the third reference voltage generation circuit 42 individually stop their operation to reduce current consumption. At this time, the switching transistor M21 and the synchronous rectification transistor M22 are turned off to cut off an electrical connection, to thereby stop the operations of the switching regulator 3*a*. Since the input of the low-level switching signal Smc causes the LDO 2 to operate and causes the switching regulator 3 to stop its operation in this manner, the output voltage of the LDO 2 is output from the output terminal OUT of the power supply device 1*a*.

Next, when the switching signal Smc is raised to a high level, the timing adjustment circuit 4*a* outputs the high-level control signal Sc2. Therefore, the second reference voltage generation circuit 21, the error amplification circuit 22, the oscillation circuit 23, the PWM comparator 24, the output control circuit 25*a*, the comparator 41, and the third reference voltage generation circuit 42 individually operate to start the switching regulator 3*a*. As a result, the LDO 2 and the switching regulator 3 are together in an operating state. When the comparator 41 is operated, the voltage of the output signal ERROUT of the error amplification circuit 22 and that of the reference voltage Vr3 are compared with each other. The comparator 41 outputs the low-level signal CMPOUT if the voltage of the output signal ERROUT is less than the reference voltage Vr3 and outputs the high-level signal CMPOUT if the voltage of the output signal ERROUT becomes equal to or greater than the reference voltage Vr3.

During the period in which the low-level signal CMPOUT is input, the output control circuit 25*a* makes the control signal PGATE a high level while making the control signal NGATE a low level regardless of the input pulse signal PWMOUT. Therefore, the switching transistor M21 and the synchronous rectification transistor M22 are turned off to cut off an electrical connection. When the output signal CMPOUT becomes a high level, the output control circuit 25*a* generates and outputs the control signals PGATE and NGATE in accordance with the input pulse signal PWMOUT and performs switching operations of the switching transistor M21 and the synchronous rectification transistor M22.

When the switching signal Smc is raised to a high level to start the switching regulator 3*a*, the output signal ERROUT from the error amplification circuit 22 does not reach a desired voltage, thereby causing an error in the on-duty cycle of the switching transistor M21 from a required value. Since the on-duty cycle is particularly small right after the switching regulator 3*a* is started, an undershoot is caused to occur in the output voltage VOUT. Therefore, at the starting of the switching regulator 3*a*, the switching transistor M21 and the synchronous rectification transistor M22 are forcibly turned off to cut off an electrical connection so as to cause the output voltage of LDO 2 to be output from the output terminal OUT. If the voltage of the output signal ERROUT from the error amplification circuit 22 becomes equal to or greater than Vr3, the switching transistor M21 and the synchronous rectification transistor M22 are caused to perform a switching operation to output the output voltage from the switching regulator 3*a* to the output terminal OUT, thereby making it possible to reduce the undershoot in the output voltage VOUT.

If the voltage of the output signal ERROUT from the error amplification circuit 22 becomes equal to or greater than the reference voltage Vr3, the voltage of the output signal ERROUT from the error amplification circuit 22 is reduced as the output voltage VOUT increases in the switching regulator 3*a*, and the duty cycle of the pulse signal PWMOUT from the PWM comparator 24 is decreased. As a result, the ON time of the switching transistor M21 becomes short, and accordingly, the ON time of the synchronous rectification transistor M23 becomes long, so that the output voltage VOUT is controlled to be reduced.

Furthermore, the voltage of the output signal ERROUT from the error amplification circuit 22 is boosted as the output voltage VOUT decreases, and the duty cycle of the pulse signal PWMOUT from the PWM comparator 24 is increased. As a result, the ON time of the switching transistor M21 becomes long, and accordingly, the ON time of the synchronous rectification transistor M22 becomes short, so that the output voltage VOUT is controlled to be boosted. Through the repetition of such operations, the output voltage VOUT is controlled to be constant at a predetermined voltage.

Next, when a first predetermined time T1 has elapsed after the switching signal Smc is raised to a high level, the timing adjustment circuit 4*a* causes the control signal Sc1 to fall to a low level, stops the operations of the first reference voltage generation circuit 11 and the error amplification circuit 12 to reduce current consumption, and turns off the output transistor M11 to stop the operation of the LDO 2.

Thus, the power supply device 1 according to the second embodiment of the present invention selects and actuates either of the LDO 2 or the switching regulator 3 in accordance with the switching signal Smc from the outside. When making the switch from the LDO 2 to the switching regulator 3*a* so as to be actuated, the power supply device 1 causes the operation periods of the LDO 2 and the switching regulator 3*a* to overlap each other. When the switching regulator 3*a* is started, the switching transistor M21 and the synchronous rectification transistor M22 are turned off to cut off an electrical connection until the output voltage ERROUT of the error amplification circuit 22 becomes equal to or greater than the reference voltage Vr3. The overlapped period is set equal to or longer than that required for making the voltage of the output signal ERROUT of the error amplification circuit 22 become equal to or greater than the reference voltage Vr3 at the starting of the switching regulator 3. Thus, it is possible to obtain the same effects as the first embodiment.

The present application is based on Japanese Priority Patent Application No. 2006-237871, filed on Sep. 1, 2006, the entire contents of which are hereby incorporated by reference.

What is claimed is:

1. A power supply device that outputs an input voltage input to an input terminal from a predetermined output terminal as an output voltage after converting it into a predetermined voltage, the device comprising:

a synchronous rectification switching regulator that outputs the input voltage to the output terminal after converting it into a predetermined voltage;

a linear regulator that outputs the input voltage to the output terminal after converting it into a predetermined voltage; and a timing adjustment circuit unit that controls driving of the linear regulator and the synchronous rectification switching regulator in accordance with a control signal input from an outside;

wherein the synchronous rectification switching regulator is controlled to be driven by the control signal from the outside and reduces current drive performance of a synchronous rectification transistor that discharges an inductor charged with the input voltage by a switching operation of a switching transistor until a predetermined signal has been input from the timing adjustment circuit unit after being started with the control signal from the outside;

wherein the synchronous rectification switching regulator comprises:

the switching transistor which is configured to perform the switching operation in accordance with a first input control signal;

the inductor charged with the input voltage by the switching operation of the switching transistor;

a first synchronous rectification transistor that performs a switching operation in accordance with a second input control signal to discharge the inductor;

a second synchronous rectification transistor having current drive performance lower than that of the first synchronous rectification transistor and performing a switching operation in accordance with a third input control signal to discharge the inductor;

a control circuit unit that performs switching control with respect to the switching transistor so that the output voltage output from the output terminal becomes the predetermined voltage while causing at least one of the first synchronous rectification transistor and second synchronous rectification transistor to perform a switching operation contrary to the switching transistor;

wherein the control circuit unit turns off the first synchronous rectification transistor to cut off an electrical connection while using the second synchronous rectification transistor to discharge the inductor during the signal for reducing the current drive performance of the synchronous rectification transistor being input from the timing adjustment circuit unit.

2. The power supply device according to claim 1, wherein, when the control signal from the outside indicating the switch from the linear regulator to the synchronous rectification switching regulator is input, the timing adjustment circuit unit actuates the linear regulator during a first predetermined time and stops an operation of the linear regulator when the first predetermined time has elapsed.

3. The power supply device according to claim 2, wherein the timing adjustment circuit unit outputs the predetermined signal to the synchronous rectification switching regulator to reduce the current drive performance of the synchronous rectification transistor until a second predetermined time longer than the first predetermined time has elapsed after the synchronous rectification switching regulator is started.

4. The power supply device according to claim 1, wherein the control circuit unit comprises an error amplification circuit that amplifies and outputs a voltage difference between a proportional voltage proportional to the output voltage as a voltage of the output terminal and a predetermined reference voltage, and a first predetermined time is equal to or longer than time required for making an output voltage of the error amplification circuit become equal to or greater than a predetermined value after the error amplification circuit is started, at the starting of the synchronous rectification switching regulator.

5. A power supply device that outputs an input voltage input to an input terminal from a predetermined output terminal as an output voltage after converting it into a predetermined voltage, the device comprising:

a synchronous rectification switching regulator that outputs the input voltage to the output terminal after converting it into a predetermined voltage;

a linear regulator that outputs the input voltage to the output terminal after converting it into a predetermined voltage; and a timing adjustment circuit unit that controls driving of the linear regulator and the synchronous rectification switching regulator in accordance with a control signal input from an outside; wherein the synchronous rectification switching regulator comprises an error amplification circuit that amplifies and outputs a voltage difference between a proportional voltage proportional to the output voltage as a voltage of the output terminal and a predetermined reference voltage, and forcibly turns off each of a switching transistor that charges an inductor and a synchronous rectification transistor that discharges the inductor to cut off an electrical connection until an output voltage of the error amplification circuit has become equal to or greater than a predetermined value after the error amplification circuit is started, at the starting of the synchronous rectification switching regulator.

6. The power supply device according to claim 5, wherein, when the control signal from the outside indicating the switch and drive from the linear regulator to the synchronous rectification switching regulator is input, the timing adjustment circuit unit actuates each of the linear regulator and the synchronous rectification switching regulator during a first predetermined time and stops an operation of the linear regulator when the first predetermined time has elapsed.

7. The power supply device according to claim 6, wherein the first predetermined time is equal to or longer than time required for making the output voltage of the error amplification circuit become equal to or greater than the predetermined value after the error amplification circuit is started, at the starting of the synchronous rectification switching regulator.

8. An operations control method of a power supply device that includes a synchronous rectification switching regulator and a linear regulator, which outputs an input voltage input to an input terminal from a predetermined output terminal as an output voltage after converting it into a predetermined voltage, and switches and actuates either of the synchronous rectification switching regulator or the linear regulator in accordance with a control signal from an outside, the synchronous rectification switching regulator including a switching transistor configured to perform a switching operation in accordance with a first input control signal, an inductor charged with the input voltage by the switching operation of the switching transistor, a first synchronous rectification transistor configured to perform a switching operation in accordance with a second input control signal to discharge the inductor, a second synchronous rectification transistor having current drive performance lower than that of the first synchronous rectification transistor and configured to perform a switching operation in accordance with a third input control signal to discharge the inductor, and a control circuit unit that performs switching control with respect to the switching transistor so that the output voltage output from the output terminal becomes the predetermined voltage while causing at least one of the first synchronous rectification transistor and second synchronous rectification transistor to perform a switching operation contrary to the switching transistor, the method comprising:

actuating the linear regulator during a first predetermined time and reducing the current drive performance of the synchronous rectification transistor of the synchronous rectification switching regulator until a second predetermined time longer than the first predetermined time has elapsed when the control signal indicating switching from the linear regulator to the synchronous rectification switching regulator is input from the outside; and turning off the first synchronous rectification transistor to cut off an electrical connection while using the second synchronous rectification transistor having the current drive performance lower than that of the first synchronous rectification transistor to perform a switching operation contrary to the switching transistor, when reducing the current drive performance of the synchronous rectification transistor of the synchronous rectification switching regulator.

9. The operations control method of the power supply device according to claim 8, wherein the operation of the linear regulator is stopped when the first predetermined time has elapsed after the control signal from the outside indicating the switch from the linear regulator to the synchronous rectification switching regulator is input.

10. An operations control method of a power supply device that comprises a synchronous rectification switching regulator and a linear regulator that outputs an input voltage input to an input terminal from a predetermined output terminal as an output voltage after converting it into a predetermined voltage and switches and actuates either of the synchronous rectification switching regulator or the linear regulator in accordance with a control signal from an outside, the method comprising:

forcibly stopping an output of a voltage of the synchronous rectification switching regulator until a signal voltage obtained by amplifying a voltage difference between a proportional voltage proportional to the output voltage as a voltage of the output terminal and a predetermined reference voltage becomes equal to or greater than a predetermined value when the control signal from the outside indicating the switch from the linear regulator to the synchronous rectification switching regulator is input.

11. The operations control method of the power supply device according to claim 10, wherein the linear regulator is actuated until the signal voltage obtained by amplifying the voltage difference between the proportional voltage and the predetermined reference voltage becomes equal to or greater than the predetermined value when the control signal from the outside indicating the switch from the linear regulator to the synchronous rectification switching regulator is input.

* * * * *